US006604917B2

(12) United States Patent
Casper et al.

(10) Patent No.: US 6,604,917 B2
(45) Date of Patent: Aug. 12, 2003

(54) LIGHT-WEIGHT ELECTRIC MOTOR DRIVEN FLUID PUMP ASSEMBLY

(75) Inventors: Ann M. Casper, Roxbury, CT (US); John F. O'Connor, Jr., New Hartford, CT (US); John F. O'Connor, Sr., deceased, late of Torrington, CT (US), by Maureen O'Connor, executrix

(73) Assignee: Torrington Research Company, Torrington, CT (US)

( * ) Notice: Subject to any disclaimer, the term of this patent is extended or adjusted under 35 U.S.C. 154(b) by 0 days.

(21) Appl. No.: 09/971,529

(22) Filed: Oct. 4, 2001

(65) Prior Publication Data

US 2002/0041814 A1 Apr. 11, 2002

Related U.S. Application Data

(60) Provisional application No. 60/238,143, filed on Oct. 6, 2000.

(51) Int. Cl.[7] ..... F04B 17/00; F04B 35/04

(52) U.S. Cl. ..... 417/423.14; 417/420; 417/423.7

(58) Field of Search ..... 417/423.5, 423.8, 417/423.14, 420, 421, 366–371, 352, 353, 355, 351, 423.7

(56) References Cited

U.S. PATENT DOCUMENTS 3,630,645 A * 12/1971 Eheim ..... 417/420
4,234,293 A * 11/1980 Lightle ..... 417/365
4,806,080 A * 2/1989 Mizobchi et al. ..... 417/353
5,009,578 A * 4/1991 Hyland ..... 417/365
5,055,006 A * 10/1991 Kobayashi et al. ..... 417/366
5,388,970 A * 2/1995 Muckelmann et al. ..... 417/363
5,823,753 A * 10/1998 Kemmerling ..... 417/423.14
5,895,207 A * 4/1999 Burgdorf et al. ..... 417/410.1
5,915,931 A * 6/1999 Lindner et al. ..... 417/420
6,095,771 A * 8/2000 Schelhas et al. ..... 417/423.14
6,274,962 B1 * 8/2001 Kliman ..... 310/261

* cited by examiner

*Primary Examiner*—Charles G. Freay
*Assistant Examiner*—Han L Liu
(74) *Attorney, Agent, or Firm*—Theodore R. Paulding

(57) ABSTRACT

A light-weight electric motor driven fluid pump assembly having a molded thermoplastic housing of two parts which form a fluid impervious rotor chamber, a stationary shaft journalled in the housing parts within the chamber and carrying a magnetic rotor and a fluid impeller driven thereby. The housing parts also define inlet and discharge ports in communication with the rotor chamber adjacent the impeller blades. One portion of the housing of one housing part defines a cylindrical thin walled tubular configuration with a cylindrical exterior surface for mounting a stator thereabout. The housing parts are welded together at mating surfaces with the result that neither static nor dynamic seals are required in the assembly.

6 Claims, 4 Drawing Sheets

LIGHT-WEIGHT ELECTRIC MOTOR DRIVEN FLUID PUMP ASSEMBLY

This application claims the benefit of provisional application Ser. No. 60/238,143 filed on Oct. 6, 2000.

FIELD OF THE INVENTION

The present invention relates to a small light-weight electric motor driven fluid pump of the type having an integrated motor and pump construction resulting in a simplified design and a minimum of static and/or dynamic seals.

BACKGROUND OF THE INVENTION

Integrated electric motor-fluid pump assemblies have hereto been available but have generally exhibited an undesired complexity with a number of housing parts, protruding rotor shafts, and both static and dynamic sealing requirements.

It is the general object of the present invention to provide a small light-weight electric motor driven fluid pump assembly having a molded thermoplastic housing of no more than two mating parts which form a fluid impervious rotor chamber and which journal a stationary shaft carrying a magnetic rotor and a fluid impeller driven thereby, said housing requiring neither static nor dynamic seals and exhibiting a highly efficient integrated motor-pump design.

SUMMARY OF THE INVENTION

In fulfillment of the foregoing object and in accordance with the present invention, a light-weight electric motor driven fluid pump assembly is provided with a molded thermoplastic housing of no more than two parts which form a fluid impervious rotor chamber when assembled. A shaft is journalled within the housing at opposite ends respectively by said two housing parts and carries a rotor assembly comprising a magnetic rotor forming a first part of an electric motor and a fluid impeller driven thereby. The housing parts also define fluid and inlet discharge ports in communication with the rotor chamber adjacent the impeller and one of the housing parts which defines a portion of the rotor chamber has a relatively thin walled tubular ID) configuration with a cylindrical exterior surface in coaxial relationship with the magnetic rotor in the rotor chamber. An annular stator forming a second motor part is disposed on or about said exterior surface for magnetic co-operation with the rotor. Thus, the motor and pump are effectively integrated and there is no penetration of the housing other than the magnetic cooperation between the rotor mounted within the housing and the stator mounted externally thereof.

The two parts of the housing are joined in assembled relationship at mating surfaces and may be provided with a single continuous static seal between said surfaces, this of course constituting the most reliable of sealing arrangements. Preferably, however, there is no seal whatsoever between the two housing parts and, instead, the parts are joined in assembled relationship by a continuous weld, thus dispensing with the need for even a simple static seal. In order to facilitate effective fluid tight welding, one of the housing parts may be provided with a small continuous raised bead on its mating surface and the other of the parts may have a small continuous groove which receives and complements the bead. Finally, various welding techniques may be employed but in the presently preferred construction the two housing parts are secured in assembled relationship employing a sonic welding technique.

DRAWINGS

DETAILED DESCRIPTION OF THE PREFERRED EMBODIMENTS

Figure 1:
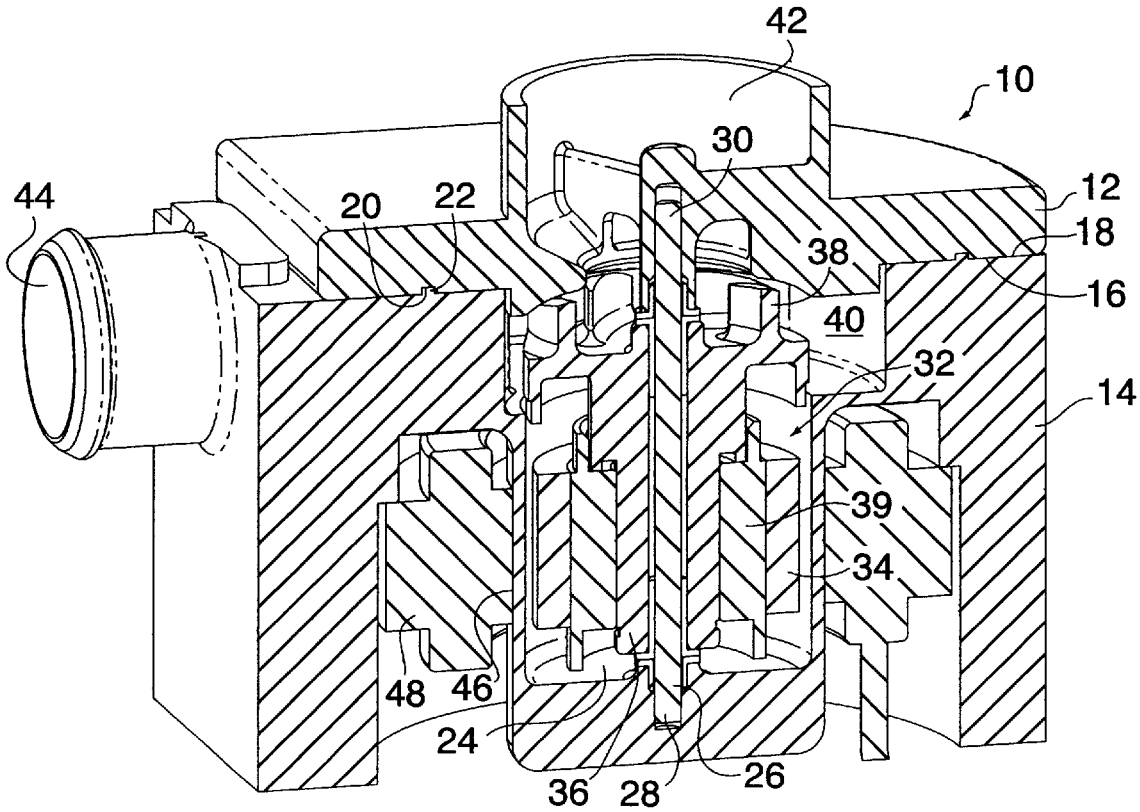
FIG. 1 is a perspective view in section of an improved motor-pump assembly constructed in accordance with the present invention.
Figure 2:
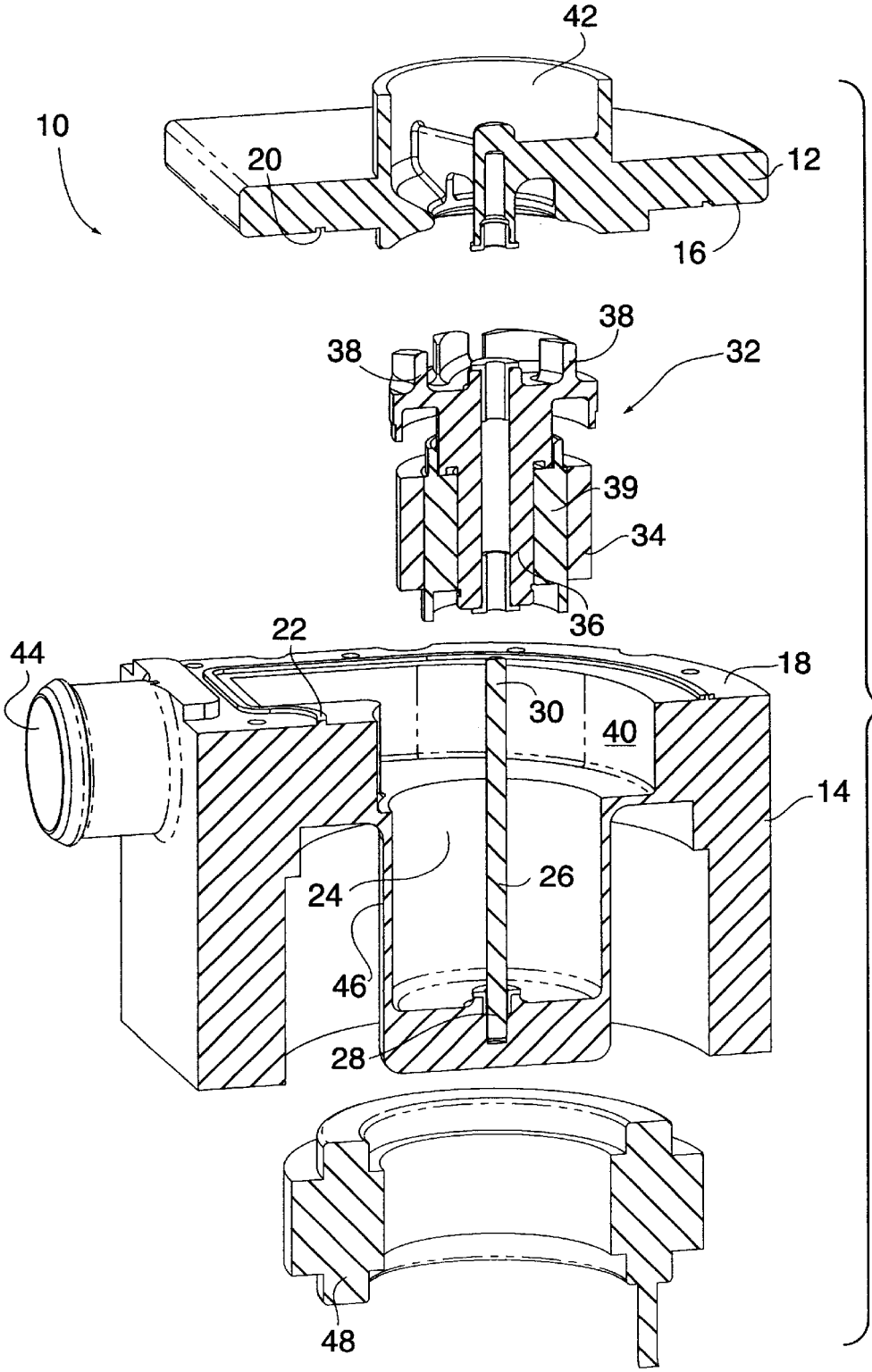
FIG. 2 is an exploded perspective view of the motor-pump assembly of FIG. 1.

Referring particularly to FIGS. 1 and 2, a motor pump assembly in accordance with the present invention is indicated generally at 10 and comprises first and second housing parts 12 and 14 shown in FIG. 1 in assembled relationship and in FIG. 2 in an exploded view prior to assembly. The parts have mating flat surfaces 16 and 18 with the surface 16 having a continuous groove 20 and the surface 18 a continuous bead 22. The groove 20 and bead 22 are complementary to facilitate welding with the parts in assembled relationship as shown in FIG. 1. Various welding techniques may be employed but sonic welding is preferred and results in a fluid tight joint thus dispensing with the need for even a static seal between the parts 12 and 14.

With the housing parts 12 and 14 in assembled relationship, they cooperatively define a fluid impervious rotor chamber 24. Stationary shaft 26 is journalled at a lower end portion 28 in the housing part 14 and at an upper end portion 30 in the upper housing part 12. Rotor assembly indicated generally at 32 is carried by the shaft 26 and comprises an annular magnetic rotor 34 which forms a first part of an electric motor and a fluid impeller 36 driven by the rotor 34. An annular rotor support member 38 is also interposed between the rotor 34 and the impeller 36 with impeller blades 38 provided at an upper end portion of the impeller. An impeller chamber 40 defined in an upper end portion of the housing part 14 communicates with an axial inlet port 42 and a radial discharge port 44, with the chamber 40 taking the configuration of a conventional scroll between its central portion and the discharge port 44.

The lower housing part 14 also has a depending thin walled portion 46 disposed about the rotor 34 and which has a smooth exterior surface for mounting an annular stator 48 forming a second part of the electric motor which drives the pump impeller 36. The stator 48 may be mounted on and about the cylindrical portion 46 by means of press fitting, adhesive bonding etc.

As will be apparent, a magnetic interaction between the rotor 34 and stator 48 will result in the desired rotation of the rotor, and the pump impeller including the blades 38. Fluid entering the assembly at the inlet 42 will be largely contained within the impeller chamber 40 but may also enter the chamber 24 there beneath so that the rotor 34, support 38, and the lower portion of the impeller will be immersed in fluid. The stator 48, on the other hand, is in a dry exterior location but nevertheless fully co-operative with the rotor 34. No seals of either the static or dynamic type are required.

Figure 3:
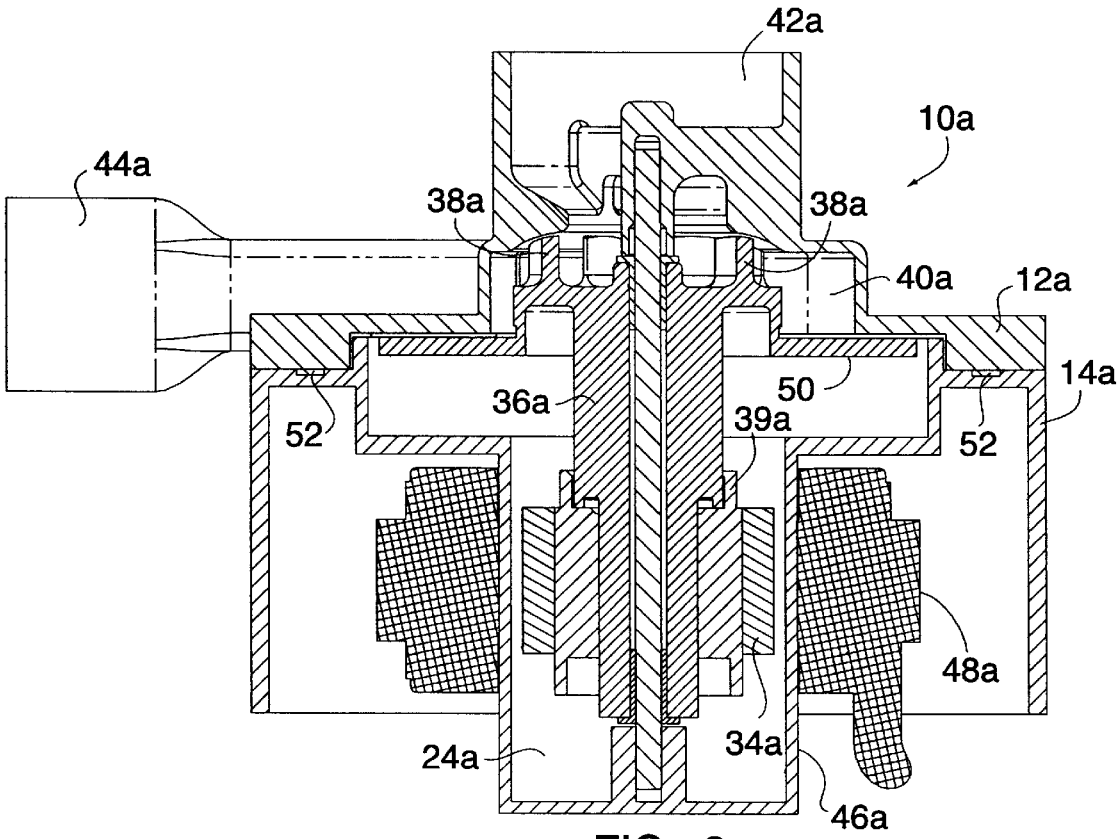
FIG. 3 is a side view in section of a second embodiment of a motor-pump assembly of the present invention.
Figure 4:
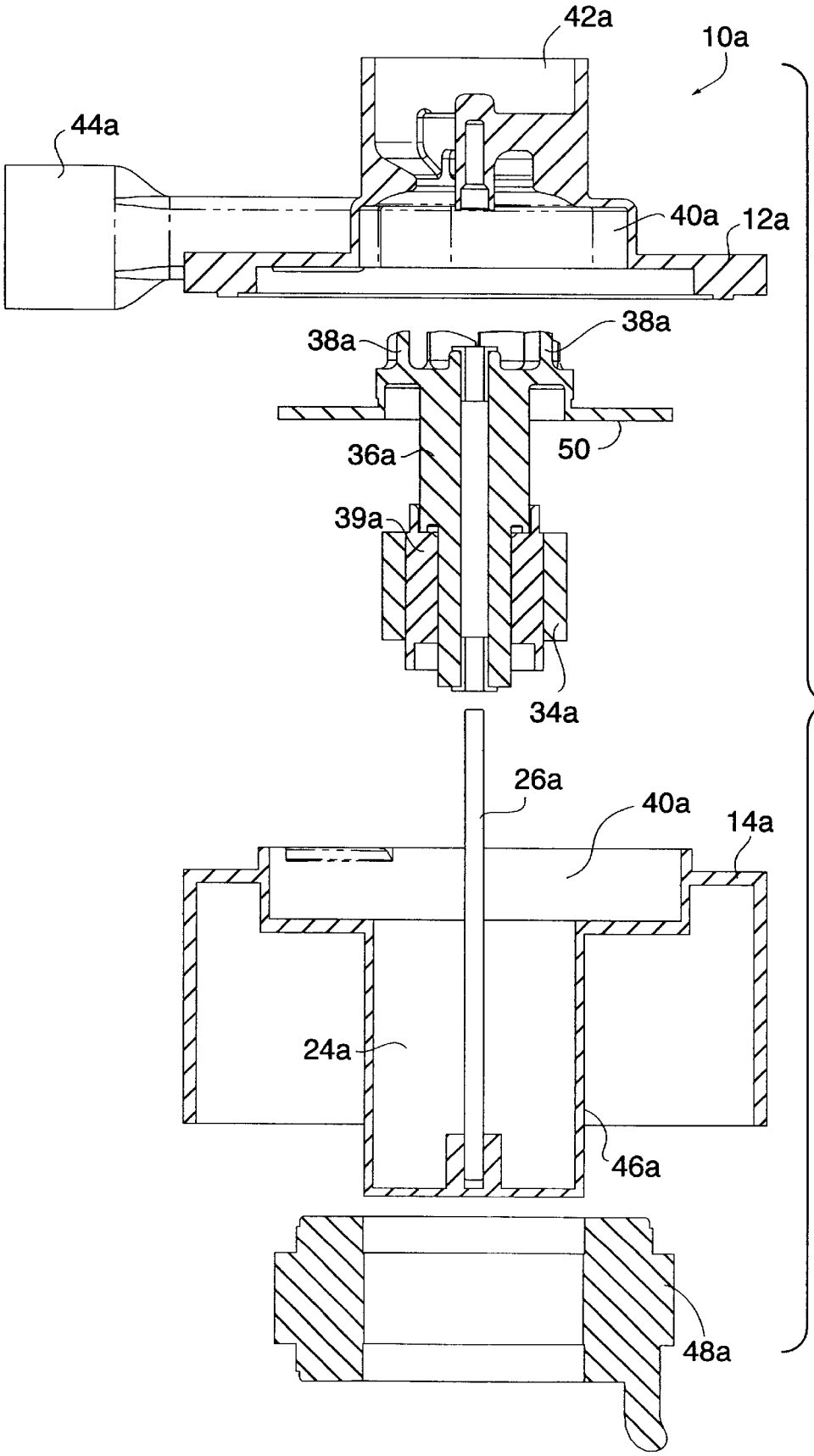
FIG. 4 is an exploded view of the motor-pump assembly of FIG. 3.

FIGS. 3 and 4 illustrate a motor-pump assembly 10*a* substantially identical with the motor assembly 10 of FIGS. 1 and 2 except for the provision of a flange 50 on the impeller. The flange 50 forms one side (the floor as shown) of an impeller or scroll housing 40*a* with the operation of the assembly remaining the same as in FIGS. 1 and 2. Fluid is largely contained in the housing 40*a* but limited flow from the scroll-impeller housing 40*a* downwardly about the flange 50 into the rotor chamber 24*a* results in immersion of the rotor 34*a*, the impeller 36*a*, and the rotor support 39*a* in the fluid being pumped by the impeller blades 38*a* . Thus, the parts within the housing portion 46*a* are immersed in fluid being pumped as in FIGS. 1 and 2 above whereas stator 48*a* is in a dry environment and yet co-operates fully with the rotor 34.

Contrary to the location of the impeller housing in the embodiment of FIGS. 1 and 2, in 3 and 4 the housing is defined within the upper housing part 12*a* and communicates internally with the discharge opening 44*a* . In assembling the housing parts 12*a* and 14*a* a weld is provided at 52 and may be of the sonic type as above. With a fluid tight weld at 52 there is no need for seals of either the static or dynamic type as in FIGS. 1 and 2.

As will be apparent from the foregoing, the integrated motor-pump assembly of the present invention is of a desirably simple construction comprising only two housing parts, a rotor assembly and a stator. The assembly operation can be completed in a most efficient manner and when the parts have been welded together at their mating surfaces a fluid impervious chamber is provided with no seals of any kind. The molded thermoplastic of the preferred light-weight construction of housing parts results in over-all light-weight construction of the assembly and together with the simplified design of the assembly results in highly efficient operation and a long service life.

What is claimed is:

1. A light-weight electric motor driven fluid pump assembly having a thermoplastic housing of no more than two parts moldable in a conventional molding process employing straight and/or side pulls and which form a fluid impervious rotor chamber when assembled, a shaft wholly within said chamber carrying a rotor assembly wholly within said chamber and comprising a magnetic rotor forming a first part of an electric motor and a fluid impeller driven thereby thus eliminating requirement for a dynamic seal, said housing parts also defining fluid inlet and discharge ports in communication with said rotor chamber adjacent said impeller, and one of said housing parts defining a portion of said rotor chamber having a relatively thin-walled tubular configuration with a cylindrical exterior surface in coaxial relationship with said magnetic rotor, and a cylindrical motor stator disposed on and about said exterior surface for magnetic cooperation with said rotor as a second motor part.

2. A light-weight electric motor driven fluid pump assembly as set forth in claim 1 wherein said two parts of said housing are joined in assembled relationship at mating surfaces by a continuous plastic weld thus dispensing with the need for a separate seal between said parts.

3. A light-weight electric motor driven fluid pump assembly as set forth in claim 2 wherein one of said housing parts has a small continuous raised bead on its mating surface, and wherein the other of said housing parts has a small continuous groove which complements said bead on said mating surface of said other part for effective fluid tight welding.

4. A light-weight electric motor driven fluid pump assembly as set forth in claim 2 wherein a sonic weld is provided between said housing parts.

5. A light-weight electronic motor driven fluid pump assembly as set forth in claim 2 wherein one housing part defines a scroll housing and a discharge opening communicating therewith, the impeller blades being located within said scroll housing and discharging radially to the discharge opening, and wherein the other housing part defines an inlet opening also in communication with said impeller blades.

6. A light-weight electric motor driven fluid pump assembly as set forth in claim 1 wherein one housing part defines an inlet opening, a discharge opening, and a scroll housing with the impeller blades in the scroll housing, and wherein the impeller carries an annular flange that forms a part of one side of the scroll housing adjacent the rotor chamber.

* * * * *